US011359842B2

(12) United States Patent
Kim et al.

(10) Patent No.: US 11,359,842 B2
(45) Date of Patent: Jun. 14, 2022

(54) AIR CONDITIONING APPARATUS

(71) Applicant: LG Electronics Inc., Seoul (KR)

(72) Inventors: Donghwi Kim, Seoul (KR); Yongcheol Sa, Seoul (KR); Jaehwa Jung, Seoul (KR); Daehyoung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 251 days.

(21) Appl. No.: 16/785,404

(22) Filed: Feb. 7, 2020

(65) Prior Publication Data

US 2020/0309417 A1 Oct. 1, 2020

(30) Foreign Application Priority Data

Mar. 27, 2019 (KR) ..... 10-2019-0035319

(51) Int. Cl.
*F25B 5/02* (2006.01)
*F24F 1/32* (2011.01)
(Continued)

(52) U.S. Cl.
CPC ..... *F25B 5/02* (2013.01); *F24F 1/32* (2013.01); *F25B 13/00* (2013.01); *F25B 29/003* (2013.01);
(Continued)

(58) Field of Classification Search
CPC ..... F25B 5/02; F25B 13/00; F25B 29/003; F25B 41/20; F25B 2313/004; F25B 2013/009; F25B 2313/003; F25B 41/22; F25B 13/02; F25B 13/30; F25B 5/00; F25B 39/00
See application file for complete search history.

(56) References Cited

U.S. PATENT DOCUMENTS

2011/0146339 A1* 6/2011 Yamashita ..... F24F 11/30 62/513
2011/0192189 A1* 8/2011 Morimoto ..... F25B 13/00 62/513
(Continued)

FOREIGN PATENT DOCUMENTS

CN 1322275 6/2007
EP 2431675 3/2012
(Continued)

OTHER PUBLICATIONS

Extended European Search Report in European Appln. No. 20158197.2, dated Jul. 29, 2020, 4 pages.
(Continued)

*Primary Examiner* — Kun Kai Ma
(74) *Attorney, Agent, or Firm* — Fish & Richardson P.C.

(57) ABSTRACT

An air conditioning apparatus includes: an outdoor unit configured to circulated refrigerant; a first pipe and a second pipe that are connected to the outdoor unit; an indoor unit configured to circulate water; and a heat exchange device that connects the outdoor unit to the indoor unit. The heat exchange device includes a first heat exchanger and a second heat exchanger that are each configured to perform heat exchange between the refrigerant and the water, a plurality of connection pipes, a bypass pipe configured to guide the refrigerant passing through the first heat exchanger to the second heat exchanger, and a bypass valve installed at the bypass pipe.

20 Claims, 9 Drawing Sheets

(51) Int. Cl.

| | |
|---|---|
| ***F25B 13/00*** | (2006.01) |
| ***F25B 29/00*** | (2006.01) |
| ***F25B 41/20*** | (2021.01) |
| ***F25B 41/40*** | (2021.01) |
| ***F24F 1/0007*** | (2019.01) |

(52) U.S. Cl.

CPC ..... *F25B 41/20* (2021.01); *F25B 41/40* (2021.01); *F24F 1/00077* (2019.02); *F25B 2313/004* (2013.01); *F25B 2313/009* (2013.01); *F25B 2313/027* (2013.01); *F25B 2313/029* (2013.01)

(56) References Cited

U.S. PATENT DOCUMENTS

| | | | | |
|---|---|---|---|---|
| 2012/0042674 | A1* | 2/2012 | Takenaka | F24F 11/30 62/180 |
| 2012/0118530 | A1 | 5/2012 | Yamashita et al. | |
| 2012/0204596 | A1* | 8/2012 | Takenaka | F25B 13/00 62/510 |
| 2012/0312042 | A1* | 12/2012 | Jeong | F25B 30/02 62/207 |
| 2013/0305758 | A1* | 11/2013 | Matsui | F25B 49/005 62/129 |
| 2014/0182320 | A1* | 7/2014 | Hatomura | F25D 21/06 62/278 |
| 2015/0027154 | A1 | 1/2015 | Lee et al. | |
| 2015/0330673 | A1* | 11/2015 | Honda | F25B 25/005 62/324.1 |
| 2015/0369498 | A1* | 12/2015 | Motomura | F25B 47/025 62/160 |
| 2016/0003490 | A1* | 1/2016 | Motomura | F24F 3/065 62/196.1 |
| 2016/0245539 | A1 | 8/2016 | Motomura et al. | |
| 2016/0245561 | A1* | 8/2016 | Tanaka | F24F 3/065 |
| 2016/0305680 | A1* | 10/2016 | Eguchi | F24F 3/065 |
| 2017/0191706 | A1* | 7/2017 | Ogawa | F16K 11/076 |
| 2018/0073782 | A1* | 3/2018 | Hatanaka | F25B 25/005 |
| 2019/0063792 | A1 | 2/2019 | Kim et al. | |

FOREIGN PATENT DOCUMENTS

| | | |
|---|---|---|
| EP | 2899477 | 7/2015 |
| KR | 20050075062 | 7/2005 |
| KR | 20130127531 | 11/2013 |

OTHER PUBLICATIONS

PCT International Search Report in International Appln. No. PCT/KR2020/000710, dated May 25, 2020, 3 pages.

* cited by examiner

AIR CONDITIONING APPARATUS

CROSS-REFERENCE TO RELATED APPLICATIONS

The present application claims priority under 35 U.S.C. 119 and 35 U.S.C. 365 to Korean Patent Application No. 10-2019-0035319, filed on Mar. 27, 2019, which is hereby incorporated by reference in its entirety.

TECHNICAL FIELD

The present disclosure relates to an air conditioning apparatus.

BACKGROUND

Air conditioning apparatus may maintain air within a space to be a proper state according to use and purpose thereof. In some examples, an air conditioning apparatus may include a compressor, a condenser, an expansion device, and evaporator. The air conditioning apparatus may perform a refrigerant cycle including compression, condensation, expansion, and evaporation processes with refrigerant. In some cases, the air conditioning apparatus may heat or cool a predetermined space.

The air conditioning apparatus may be used in various places. For example, the air conditioning apparatus may be used at a home or an office.

In some examples, when the air conditioning apparatus performs a cooling operation, an outdoor heat-exchanger provided in an outdoor unit may serve as a condenser, and an indoor heat-exchanger provided in an indoor unit may serve as an evaporator. In some examples, when the air conditioning apparatus performs a heating operation, the indoor heat-exchanger may serve as the condenser, and the outdoor heat-exchanger may serve as the evaporator.

In some cases, the type and amount of refrigerant used in the air conditioning apparatus may be limited due to environmental regulations. In some examples, to reduce an amount of refrigerant used, an air conditioning system may perform cooling or heating by performing heat exchange between the refrigerant and a predetermined fluid such as water.

In some examples, a plate-type heat exchanger may exchange heat between a refrigerant and water to generate heat to thereby perform cooling, heating, hot water supply, or cold water supply. In some cases, where a refrigerant flow path is provided in the same manner regardless of whether the plate-type heat exchanger functions as a condenser or an evaporator, heat exchange performance may be degraded.

SUMMARY

The present disclosure describes an air conditioning apparatus in which a refrigerant flow path varies in a heat exchange device during a cooling operation or a heating operation to improve performance.

The present disclosure also describes an air conditioning apparatus in which, when a plurality of heat exchangers, which are provided in the heat exchange device, act as evaporators during a cooling operation, a refrigerant is branched and introduced into the plurality of heat exchangers to increase in number of refrigerant flow paths and reduce a length of each of the refrigerant flow paths (parallel connection between the heat exchangers), thereby preventing an evaporation pressure from being reduced.

The present disclosure describes an air conditioning apparatus in which, when a plurality of heat exchangers act as condensers during a heating operation, a refrigerant sequentially passes through the plurality of heat exchangers to increase in length and reduce in number of refrigerant flow paths (series connection between the heat exchangers), thereby improving condensation performance in the heat exchangers.

The present disclosure describes an air conditioning apparatus in which an outdoor unit and a heat exchange device are connected to each other through two pipes to simplify a configuration thereof when a switching operation for a cooling operation or a heating operation is performed.

The present disclosure describes an air conditioning apparatus in which, a simultaneous operation in which a cooling operation and a heating operation are performed at the same time, an outdoor unit and a heat exchange device are connected to each other through three pipes to facilitate circulation of a refrigerant.

The present disclosure describes an air conditioning apparatus in which a configuration of a heat exchange device connected to an outdoor unit through two pipes and a configuration of a heat exchange device connected to the outdoor unit through three pipes are almost similar to each other except that the pipes are grounded so that the heat exchange device for a switching operation or a simultaneous operation is easily manufactured.

According to one aspect of the subject matter described in this application, an air conditioning apparatus includes: an outdoor unit configured to circulated refrigerant; a first pipe and a second pipe that are connected to the outdoor unit; an indoor unit configured to circulate water; and a heat exchange device that connects the outdoor unit to the indoor unit. The heat exchange device includes: a first heat exchanger and a second heat exchanger that are each configured to perform heat exchange between the refrigerant and the water; a first connection pipe that is connected to the first pipe and that extends to the first heat exchanger; a second connection pipe that extends from the first connection pipe to the second heat exchanger; a third connection pipe that is connected to the second pipe and that extends to the first heat exchanger; a bypass pipe that extends from the third connection pipe to the second connection pipe and that is configured to guide the refrigerant passing through the first heat exchanger to the second heat exchanger, and a bypass valve installed at the bypass pipe.

Implementations according to this aspect may include one or more of the following features. For example, the air conditioning apparatus may further include a first branch part disposed at the first connection pipe, and the second connection pipe may be connected to the first branch part and to the second heat exchanger. In some examples, the air conditioning apparatus may further include: a first combination part disposed at the second connection pipe, and a second combination part disposed at the third connection pipe, where the bypass pipe extends from the first combination part to the second combination part. In some implementations, the air conditioning apparatus may further include a first switching valve installed at the second connection pipe and disposed between the first branch part and the first combination part.

In some implementations, the indoor unit may include a first indoor unit and a second indoor unit, and the first heat exchanger may include: a first refrigerant flow path connected to the first connection pipe and a first water flow path connected to the first indoor unit. In some examples, the second heat exchanger may include: a second refrigerant flow path connected to the second connection pipe, and a second water flow path connected to the second indoor unit.

In some implementations, the outdoor unit and the heat exchange device may be coupled to each other by two pipes including the first pipe and the second pipe. In some examples, the air conditioning apparatus may further include: a second branch part disposed at the third connection pipe; and a fourth connection pipe that extends from the second branch part to the second heat exchanger.

In some implementations, the air conditioning apparatus may further include a first expansion valve installed at the third connection pipe and disposed between the second branch part and the second combination part. In some implementations, the air conditioning apparatus may further include a second expansion valve installed at the fourth connection pipe. In some implementations, the bypass valve may include a second switching valve configured to adjust opening and closing of the bypass pipe.

In some implementations, the air conditioning apparatus may further include a third pipe coupled to the outdoor unit, where the outdoor unit and the heat exchange device are coupled to each other by three pipes including the first pipe, the second pipe, and the third pipe. In some examples, the heat exchange device may further include a fourth connection pipe that is connected to the third pipe and that extends to the second heat exchanger. In some implementations, the air conditioning apparatus may further include: a first expansion valve installed at the third connection pipe; and a second expansion valve installed at the fourth connection pipe, where the bypass valve may include a third expansion valve installed at the bypass pipe.

In some implementations, the first heat exchanger or the second heat exchanger may include a plate-shaped heat exchanger.

According to another aspect, an air conditioning apparatus includes: an outdoor unit configured to circulate refrigerant; a first pipe and a second pipe that are connected to the outdoor unit; an indoor unit configured to circulate water; and a heat exchange device that connects the outdoor unit to the indoor unit. The heat exchange device includes: a first heat exchanger and a second heat exchanger that are configured to perform heat exchange between the refrigerant and the water; a first connection pipe that is connected to the first pipe and that extends to the first heat exchanger, the first connection pipe including a first branch part; a second connection pipe that extends from the first branch part of the first connection pipe to the second heat exchanger, the second connection pipe including a first combination part; a third connection pipe that is connected to the second pipe and that extends the first heat exchanger, the third connection pipe including a second branch part and a second combination part; a fourth connection pipe that extends from the second branch part of the third connection pipe to the second heat exchanger; first expansion valve installed at the third connection pipe; a bypass pipe that extends from the first combination part of the second connection pipe to the second combination part of the third connection pipe, and a bypass valve installed at the bypass pipe.

Implementations according to this aspect may include one or more of the following features. For example, the indoor unit may include a first indoor unit and a second indoor unit. The first heat exchanger may include a first refrigerant flow path connected to the first connection pipe and a first water flow path connected to the first indoor unit, and the second heat exchanger may include: a second refrigerant flow path coupled to the second connection pipe, and a second water flow path connected to the second indoor unit.

In some implementations, the first expansion valve may be disposed between the second branch part and the second combination part. In some implementations, the air conditioning apparatus may further include a third pipe coupled to the outdoor unit, and the outdoor unit and the heat exchange device may be coupled to each other by three pipes including the first pipe, the second pipe, and the third pipe. In some implementations, the air conditioning apparatus may further include a second expansion valve installed at the fourth connection pipe.

In some implementations, the heat exchange device may be connected to the outdoor unit through the two or three pipes to perform the switching operation or the simultaneous operation according to operation requirements, thereby improving a degree of freedom of installation.

In some implementations, the air conditioning apparatus may include a heat exchange device including a heat exchanger configured to connect to an outdoor unit to an indoor unit and perform heat exchange between a refrigerant and water, thereby reducing an amount of refrigerant to be used to perform a cooling operation and a heating operation.

In some implementations, the heat exchange device may be connected to the outdoor unit through two pipes or three pipes, the connection to the outdoor unit may be easily performed according to requirements of the operation of the air conditioning apparatus, i.e., a switching operation or a simultaneous operation.

In some implementations, a flow path and a valve structure that vary in flow of the refrigerant are provided in the heat exchange device, and the refrigerant flow path may be differently provided according to whether to perform the cooling operation or the heating operation during the switching operation, thereby improving system performance.

In some implementations, the refrigerant introduced into the heat exchanger is branched and introduced into two or more heat exchangers during the cooling operation, and the number of refrigerant flow paths may increase, and a length of each of the refrigerant flow paths may decrease to reduce a pressure loss.

In some examples, since the refrigerant introduced into the heat exchanger sequentially passes through two or more heat exchangers during the heating operation, the number of refrigerant flow paths may be reduced, and the length of each of the refrigerant flow paths may increase to improve heat transfer performance.

The details of one or more implementations are set forth in the accompanying drawings and the description below. Other features will be apparent from the description and drawings, and from the claims.

DETAILED DESCRIPTION

Hereinafter, one or more example implementations will be described with reference to the accompanying drawings. The disclosure may, however, be implemented in many different forms and should not be construed as being limited to the implementations set forth herein; rather, that alternate implementations included in other retrogressive disclosures or falling within the spirit and scope of the present disclosure will fully convey the concept of the disclosure to those skilled in the art.

Figure 1:
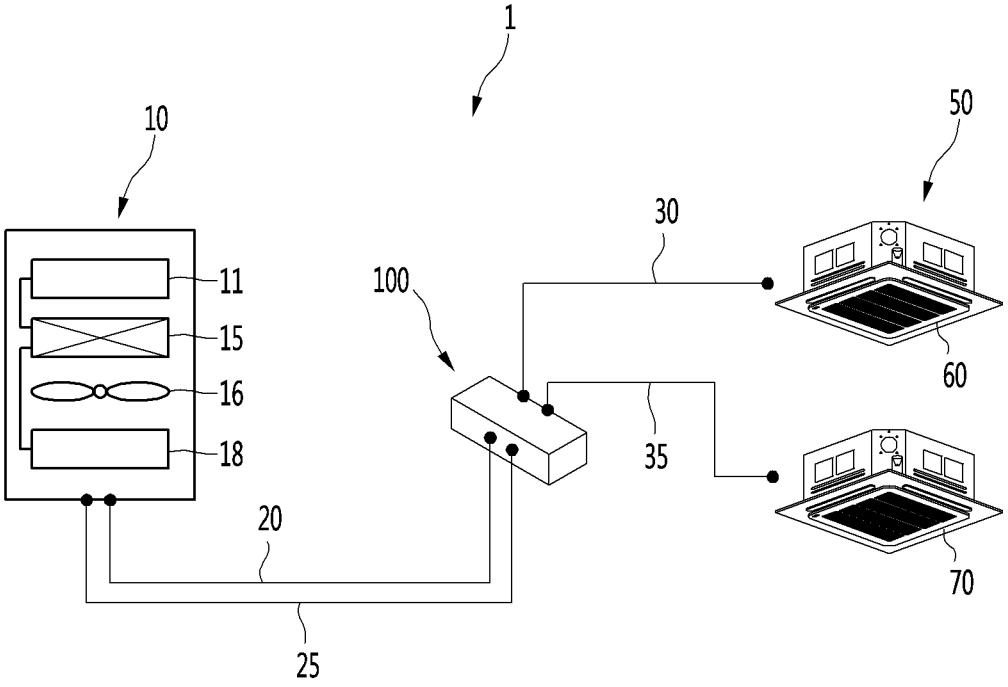
FIG. 1 is a schematic view illustrating an example configuration of an air conditioning apparatus.

FIG. 1 is a schematic view illustrating an example configuration of an air conditioning apparatus.

Referring to FIG. 1, an air conditioning apparatus 1 includes an outdoor unit 10, an indoor unit 50, and a heat exchange device 100 connected to the outdoor unit 10 and the indoor unit 50.

The outdoor unit 10 and the heat exchange device 100 may be fluidly connected by a first fluid. For example, the first fluid may include a refrigerant. The refrigerant may flow through a refrigerant-side flow path of a heat exchanger provided in the heat exchange device 100 and the outdoor unit 10.

The outdoor unit 10 may include a compressor 11 and an outdoor heat exchanger 15. An outdoor fan 16 may be provided at one side of the outdoor heat exchanger 15 to blow external air toward the outdoor heat exchanger 15 so that heat exchange between the external air and the refrigerant of the outdoor heat exchanger 15 is performed. Also, a main electronic expansion valve 18 may be further provided in the outdoor unit 10.

The air conditioning apparatus 1 further include two pipes 20 and 25 connecting the outdoor unit 10 to the heat exchange device 100. The two pipes 20 and 25 include a first pipe 20 as a gas pipe through which a gas refrigerant flows and a second pipe 25 as a liquid pipe through which a liquid refrigerant flows. That is, the outdoor unit 10 and the heat exchange device 100 may have a "two pipe connection structure", and the refrigerant may circulate through the outdoor unit 10 and the heat exchange device 100 via the two pipes 20 and 25.

The heat exchange device 100 and the indoor unit 50 may be fluidly connected by a second fluid. For example, the second fluid may include water. The water may flow through a water-side flow path of a heat exchanger provided in the heat exchange device 100 and the indoor unit 50.

That is, the heat exchanger includes the refrigerant-side flow path and the water-side flow path. For example, the heat exchanger may include a plate-type heat exchanger in which the water and the refrigerant are heat-exchanged with each other.

The indoor unit 50 may include a plurality of indoor units 60 and 70. The plurality of indoor units 60 and 70 include a first indoor unit 60 and a second indoor unit 70. Although two indoor units are connected to the heat exchange device 100 in FIG. 1, the implementation is not limited thereto. For example, three or more indoor units may be connected to the heat exchange device 100.

The air conditioning apparatus 1 further includes pipes 30 and 35 connecting the heat exchange device 100*a* to the indoor unit 50. The pipes 30 and 35 include a first indoor unit connection pipe 30 connecting the heat exchange device 100*a* to the first indoor unit 60 and a second indoor unit connection pipe 35 connecting the heat exchange device 100*a* to the second indoor unit 70.

The water may circulate through the heat exchange device 100*a* and the indoor unit 50 via the first and second indoor unit connection pipes 30 and 35. As the number of indoor units increases, the number of pipes connecting the heat exchange device 100*a* to the indoor units may also increase.

In some implementations, the refrigerant circulating through the outdoor unit 10 and the heat exchange device 100 and the water circulating through the heat exchange device 100 and the indoor unit 50 may be heat-exchanged with each other through the heat exchanger 110,115 (see FIG. 2) provided in the heat exchange device 100, and water cooled or heated through the heat exchange may be heat-exchanged with an indoor heat exchanger 61,71 (see FIG. 2) provided in the indoor unit 50 to perform cooling or heating in an indoor space.

Figure 2:
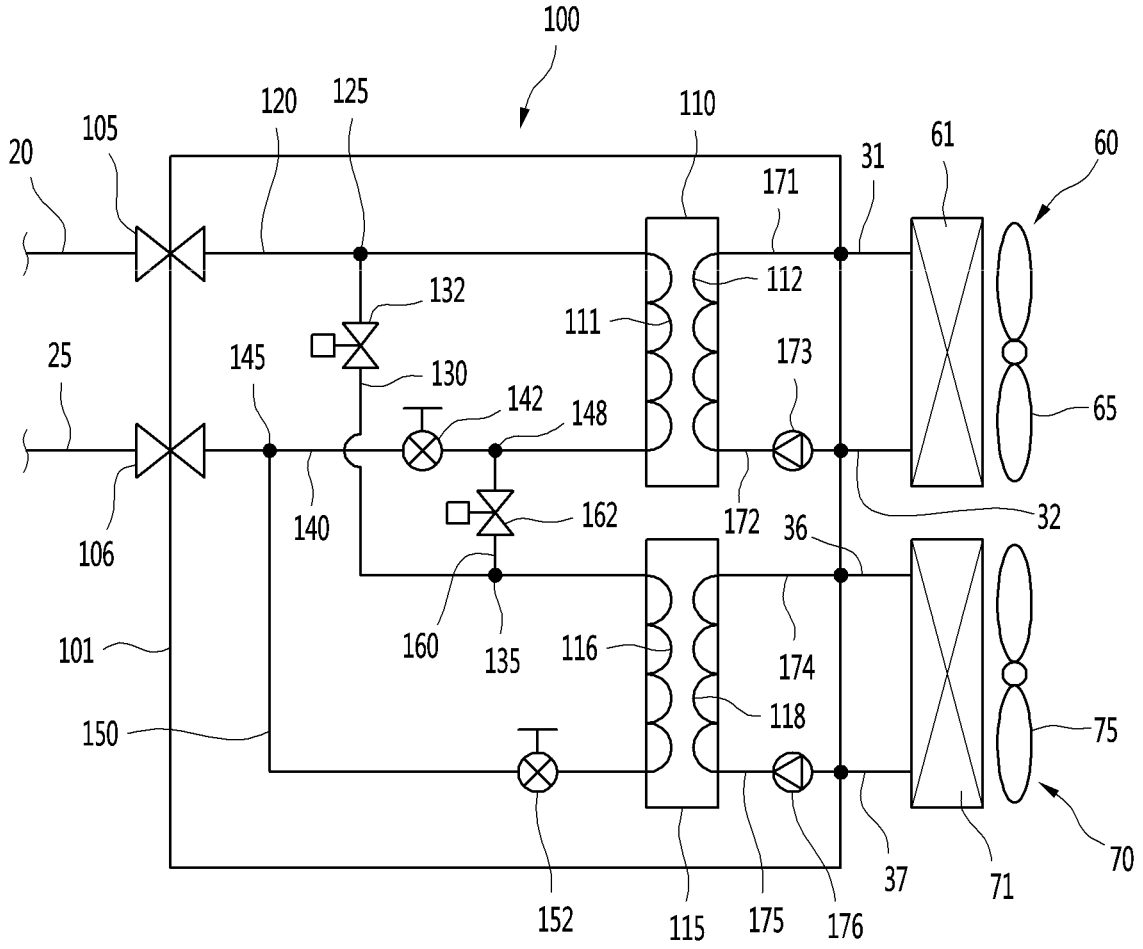
FIG. 2 is a cycle diagram illustrating an example configuration of a heat exchange device.

FIG. 2 is a cycle diagram illustrating an example configuration of a heat exchange device of the air conditioning apparatus in FIG. 1.

Referring to FIG. 2, the heat exchange device 100 includes a device case 101. The heat exchanger 110,115, the refrigerant pipe, the water pipe, a plurality of valves, and a pump may be provided in the device case 101.

In detail, the heat exchange device 100 includes a first heat exchanger 110 fluidly connected to the first indoor unit 60 and a second heat exchanger 115 fluidly connected to the second indoor unit 70.

The first heat exchanger 110 and the second heat exchanger 115 may have the same configuration. The first and second heat exchangers 110 and 115 may include a plate-type heat exchanger and be configured so that the water flow path and the refrigerant flow path are alternately stacked with each other.

The first heat exchanger 110 includes a first refrigerant flow path 111 and a first water flow path 112. The first refrigerant flow path 111 may be fluidly connected to the outdoor unit 10. Thus, the refrigerant discharged from the outdoor unit 10 may be introduced into the first refrigerant flow path 111, or the refrigerant passing through the first refrigerant flow path 111 may be introduced into the outdoor unit 10.

The first water flow path 112 may be fluidly connected to the first indoor unit 60. Thus, the water discharged from the first indoor unit 60 may be 1 introduced into the first water flow path 112, or the water passing through the first water flow path 112 may be introduced into the first indoor unit 60.

The heat exchange device 100 includes a first heat exchanger outlet pipe 171 and a first heat exchanger inlet pipe 172, which are connected to the first water flow path 112 of the first heat exchanger 110. In addition, the first indoor unit connection pipe 30 includes a first indoor unit inlet pipe 31 and a first indoor unit outlet pipe 32.

The first heat exchanger outlet pipe 171 may be connected to the first indoor unit inlet pipe 31. Therefore, the water discharged from the first water flow path 112 of the first heat exchanger 110 may be introduced into the first indoor unit 60 through the first heat exchanger outlet pipe 171 and the first indoor unit inlet pipe 31.

The first indoor unit 60 includes a first indoor heat exchanger 61 and a first indoor fan 65. The first indoor fan 65 is disposed adjacent to the first indoor heat exchanger 61 to blow indoor air so that heat exchange occurs between water passing through the first indoor heat exchanger 61 with the indoor air.

The first indoor unit inlet pipe 31 may be connected to an inlet-side of the first indoor heat exchanger 61. Also, the first indoor unit outlet pipe 32 may be connected to an outlet-side of the first indoor heat exchanger 61.

The first heat exchanger inlet pipe 172 may be provided with a first pump 173 for forcing a flow of water. When the first pump 173 is driven, water may circulate through a water-side flow path connecting the first indoor unit 60 to the first heat exchanger 110, i.e., the first indoor heat exchanger 61, the first indoor unit outlet pipe 32, the first heat exchanger inlet pipe 172, the first water flow path 112, the first heat exchanger outlet pipe 171, and the first indoor unit inlet pipe 31.

Although the first pump 173 is illustrated as being installed in the first heat exchanger inlet pipe 172 in FIG. 2, the first pump 173 may be installed in the first heat exchanger outlet pipe 171.

Similarly, the second heat exchanger 115 includes a second refrigerant flow path 116 and a second water flow path 118. The second refrigerant flow path 116 may be fluidly connected to the outdoor unit 10. Thus, the refrigerant discharged from the outdoor unit 10 may be introduced into the second refrigerant flow path 116, or the refrigerant passing through the second refrigerant flow path 116 may be introduced into the outdoor unit 10.

The second water flow path 118 may be fluidly connected to the second indoor unit 70, and the refrigerant discharged from the second indoor unit 70 may be introduced into the second water flow path 118, or the refrigerant passing through the second water flow path 118 may be introduced into the second indoor unit 70.

The heat exchange device 100 includes a first heat exchanger outlet pipe 174 and a second heat exchanger inlet pipe 175, which are connected to the water flow path 118 of the heat exchanger 115. Also, the second indoor unit connection pipe 35 includes a second indoor unit inlet pipe 36 and a second indoor unit outlet pipe 37.

The first heat exchanger outlet pipe 174 may be connected to the second indoor unit inlet pipe 36. Therefore, the water discharged from the water flow path 118 of the second heat exchanger 115 may be introduced into the second indoor unit 70 through the first heat exchanger outlet pipe 174 and the second indoor unit inlet pipe 36.

The second indoor unit 70 includes a second indoor heat exchanger 71 and a second indoor fan 75. The second indoor fan 75 is disposed adjacent to the second indoor heat exchanger 71 to blow indoor air so that heat exchange occurs between the water passing through the second indoor heat exchanger 71 with the indoor air.

The second indoor unit inlet pipe 36 may be connected to an inlet-side of the second indoor heat exchanger 71. Also, the second indoor unit outlet pipe 37 may be connected to an outlet-side of the second indoor heat exchanger 71.

The second heat exchanger inlet pipe 175 may be provided with a second pump 176 for forcing a flow of water. When the second pump 176 is driven, the water may circulate through the water-side flow path connecting the second indoor unit 70 to the second heat exchanger 115, i.e., through the second indoor heat exchanger 71, the second indoor unit outlet pipe 37, the second heat exchanger inlet pipe 175, the second water flow path 118, the first heat exchanger outlet pipe 174, and the second indoor unit inlet pipe 36.

Although the second pump 176 is illustrated as being installed in the second heat exchanger inlet pipe 175 in FIG. 2, the implementation is not limited thereto. For example, the second pump 176 may be installed in the first heat exchanger outlet pipe 174.

The heat exchange device 100 further include a first service valve 105 connected to the first pipe 20 and a second service valve 106 connected to the second pipe 25. The first and second pipes 20 and 25 may be connected to the heat exchange device 100 through the first and second service valves 105 and 106, and thus, the outdoor unit 10 and the heat exchange device 100 may realize "second pipe connection".

The heat exchange device 100 may further include a first connection pipe 120 extending from the first service valve 105 to the first heat exchanger 110. The first connection pipe 120 may be coupled to the first heat exchanger 110 and may be fluidly connected to the first refrigerant flow path 111.

The first connection pipe 120 may be fluidly connected to the first pipe 20. For example, when the heating operation is performed, a high-pressure refrigerant compressed in the compressor 11 of the outdoor unit 10 may be introduced into the first connection pipe 120 through the first pipe 20 and then be introduced into the first heat exchanger 110.

A first branch part 125 from which the second connection pipe 130 is branched is disposed on the first connection pipe 120. The second connection pipe 130 extends from the first branch part 125 to the second heat exchanger 115. The second connection pipe 130 may be coupled to the second heat exchanger 115 and may be fluidly connected to the second refrigerant flow path 116.

In some examples, the first branch part 125 may be a portion of the first connection pipe 120. In some examples, the first branch part 125 may be a separate part such as a multi-way connection pipe that connects the first connection pipe 120 to the second connection pipe 130.

The second connection pipe 130 may be fluidly connected to the first connection pipe 120 and the first pipe 20. For example, the refrigerant heat-exchanged (evaporated) in the second heat exchanger 115 during the cooling operation may be introduced into the first connection pipe 120 and flow through the first connection pipe 120.

A first switching valve 132 may be installed in the second connection pipe 130. When the first switching valve 132 is turned on (opened), the refrigerant may flow through the second connection pipe 130, and when the first switching valve 132 is turned off (closed), the flow of the refrigerant through the second connection pipe 130 may be restricted. For example, the first switching valve 132 may include a solenoid valve.

The second connection pipe 130 is combined with the bypass pipe 160 to provide a first combination part 135. The bypass pipe 160 may extend from the first combination part 135 to a second combination part 148 of the third connection pipe 140.

In some examples, the first combination part 135 may be a portion of the second connection pipe 130. In some examples, the first combination part 135 may be a separate part such as a multi-way connection pipe that connects the second connection pipe 130 to the bypass pipe 160.

The first switching valve 132 may be installed at one point of the second connection pipe 130 between the first branch part 125 and the first combination part 135.

Due to the above-described configuration, when the first switching valve 132 is turned off during the heating operation, the refrigerant passing through the first heat exchanger 110 may flow through the bypass pipe 160 and be introduced into the second heat exchanger 115 through the first combination part 135 of the second connection pipe 130. Here, a flow of the refrigerant to the first branch part 125 may be restricted.

The heat exchange device 100 may further include a third connection pipe 140 extending from the second service valve 106 to the second heat exchanger 115. The third connection pipe 140 may be coupled to the second heat exchanger 115 and may be fluidly connected to the second refrigerant flow path 116.

The third connection pipe 140 may be fluidly connected to the second pipe 25. For example, when the cooling operation is performed, the high-pressure refrigerant compressed in the heat exchanger 15 of the outdoor unit 10 may be introduced into the third connection pipe 140 through the second pipe 25 and then be introduced into the first heat exchanger 110 and the second heat exchanger 115.

A second branch part 145 from which a fourth connection pipe 150 is branched is disposed on the third connection pipe 140. The fourth connection pipe 150 extends from the second branch part 145 to the second heat exchanger 115.

In some examples, the second branch part 145 may be a portion of the third connection pipe 140. In some examples, the second branch part 145 may be a separate part such as a multi-way connection pipe that connects the third connection pipe 140 to the fourth connection pipe 150.

The fourth connection pipe 150 may be coupled to the second heat exchanger 115 and may be fluidly connected to the second refrigerant flow path 116. In detail, the second connection pipe 130 may be coupled to one end of the second refrigerant flow path 116, and the fourth connection pipe 150 may be coupled to the other end of the second refrigerant flow path 116.

For example, when the heating operation is performed, the refrigerant introduced into the second refrigerant flow path 116 from the second connection pipe 130 may be discharged to the fourth connection pipe 150. On the other hand, when the cooling operation is performed, the refrigerant flowing into the second refrigerant flow path 116 from the fourth connection pipe 150 may be discharged to the second connection pipe 130.

A second combination part 148 with which the bypass pipe 160 is combined is disposed on the third connection pipe 140. The bypass pipe 160 may extend from the first combination part 135 to the second combination part 148, and both sides of the bypass pipe 160 may be coupled to the first and second combination parts 135 and 148.

In some examples, the second combination part 148 may be a portion of the third connection pipe 140. In some examples, the second combination part 148 may be a separate part such as a multi-way connection pipe that connects the third connection pipe 140 to the bypass pipe 160.

A second switching valve 162 may be installed in the bypass pipe 160. When the second switching valve 162 is turned on (opened), the refrigerant may flow through the bypass pipe 160, and when the second switching valve 162 is turned off (closed), the flow of the refrigerant through the bypass pipe 160 may be restricted. For example, the first switching valve 132 may include a solenoid valve.

For example, during the heating operation of the air conditioning apparatus 1, the second switching valve 162 may be opened so that the refrigerant passing through the first heat exchanger 110 is introduced into the bypass pipe 160 and then is introduced into the second heat exchanger 115.

On the other hand, during the cooling operation of the air conditioning apparatus 1, the second switching valve 162 may be closed so that the flow of the refrigerant to the bypass pipe 160 is restricted.

The heat exchange device 100 may further include expansion valves 142 and 152 for decompressing the refrigerant. Each of the expansion valves 142 and 152 may include an electronic expansion valve (EEV).

The EEV may adjust a degree of opening thereof to allow a pressure of the refrigerant passing through the expansion valve to drop down. For example, when the expansion valve is fully opened, the refrigerant may pass through the expansion valve without dropping down, and when the degree of opening of the expansion valve decreases, the refrigerant may be decompressed. A degree of decompression of the refrigerant may increase as the degree of opening decreases.

In detail, the expansion valves 142 and 152 may include a first expansion valve 142 installed in the third connection pipe 140. The first expansion valve 142 may be installed at one point of the third connection pipe 140 between the second branch part 145 and the second combination part 148.

For example, during the heating operation of the air conditioning apparatus 1, the first expansion valve 142 may be closed to prevent the refrigerant passing through the first heat exchanger 110 from flowing from the second combination part 148 to the second branch part 145. Also, the refrigerant may be introduced into the bypass pipe 160 from the second combination part 148.

On the other hand, during the cooling operation of the air conditioning apparatus 1, the first expansion valve 142 may be opened, and the refrigerant passing through the third connection pipe 140 may be decompressed by the first expansion valve 142 to flow to the first heat exchanger 110.

The expansion valves 142 and 152 may further include a second expansion valve 152 installed in the fourth connection pipe 150.

For example, during the heating operation of the air conditioning apparatus 1, the second expansion valve 152 may completely opened, and the refrigerant passing through the second heat exchanger 115 may pass through the second expansion valve 152 without being decompressed and then pass through the fourth connection pipe 150 and the third connection pipe 140 so as to be discharged from the heat exchange device 100.

On the other hand, during the cooling operation of the air conditioning apparatus 1, the second expansion valve 152 is opened to an opening degree in which the refrigerant is capable of being decompressed. A portion of the refrigerant introduced into the third connection pipe 140 through the second pipe 25 may flow through the fourth connection pipe 150, and then, after being decompressed in the second expansion valve 152, the refrigerant may be evaporated in the second heat exchanger 115.

Figure 3:
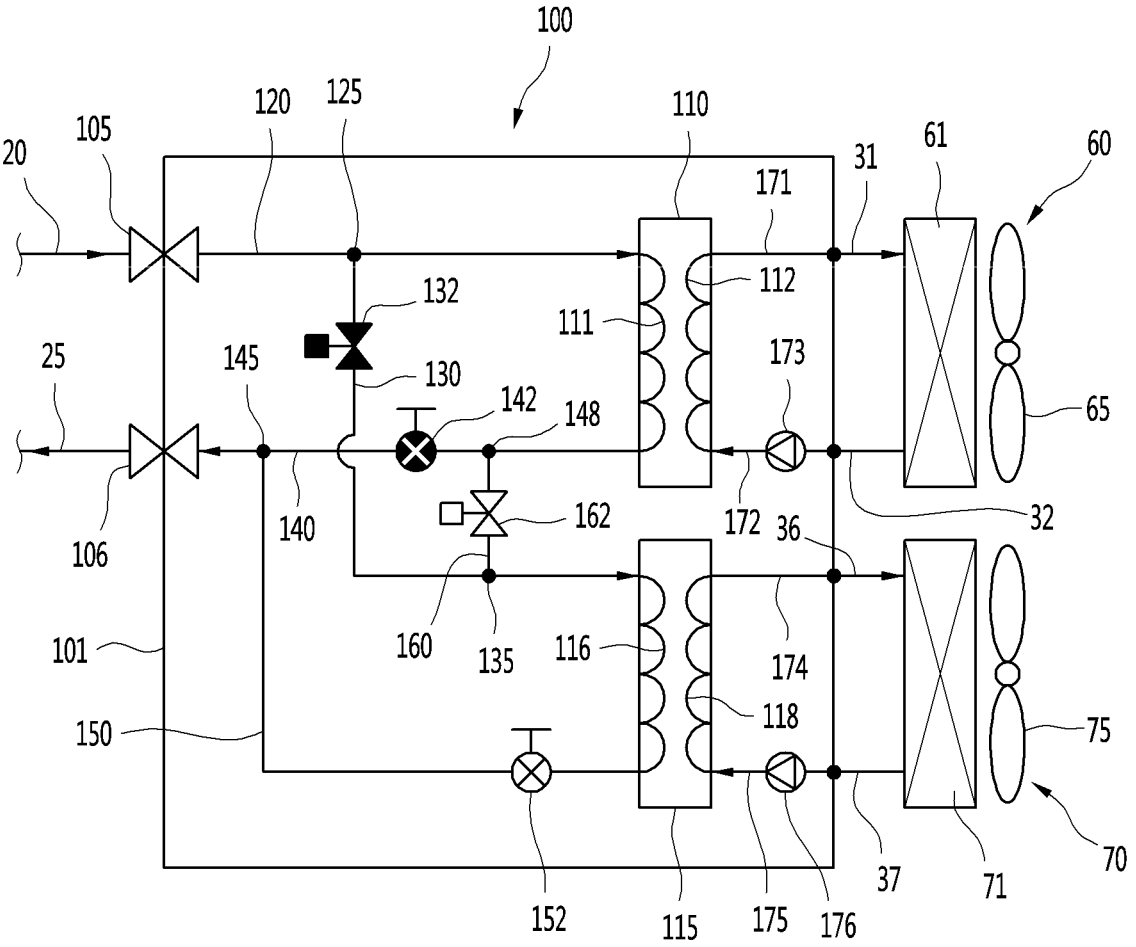
FIG. 3 is a cycle diagram illustrating an example of flow of refrigerant in the heat exchange device during a heating operation of the air conditioning apparatus.
Figure 4:
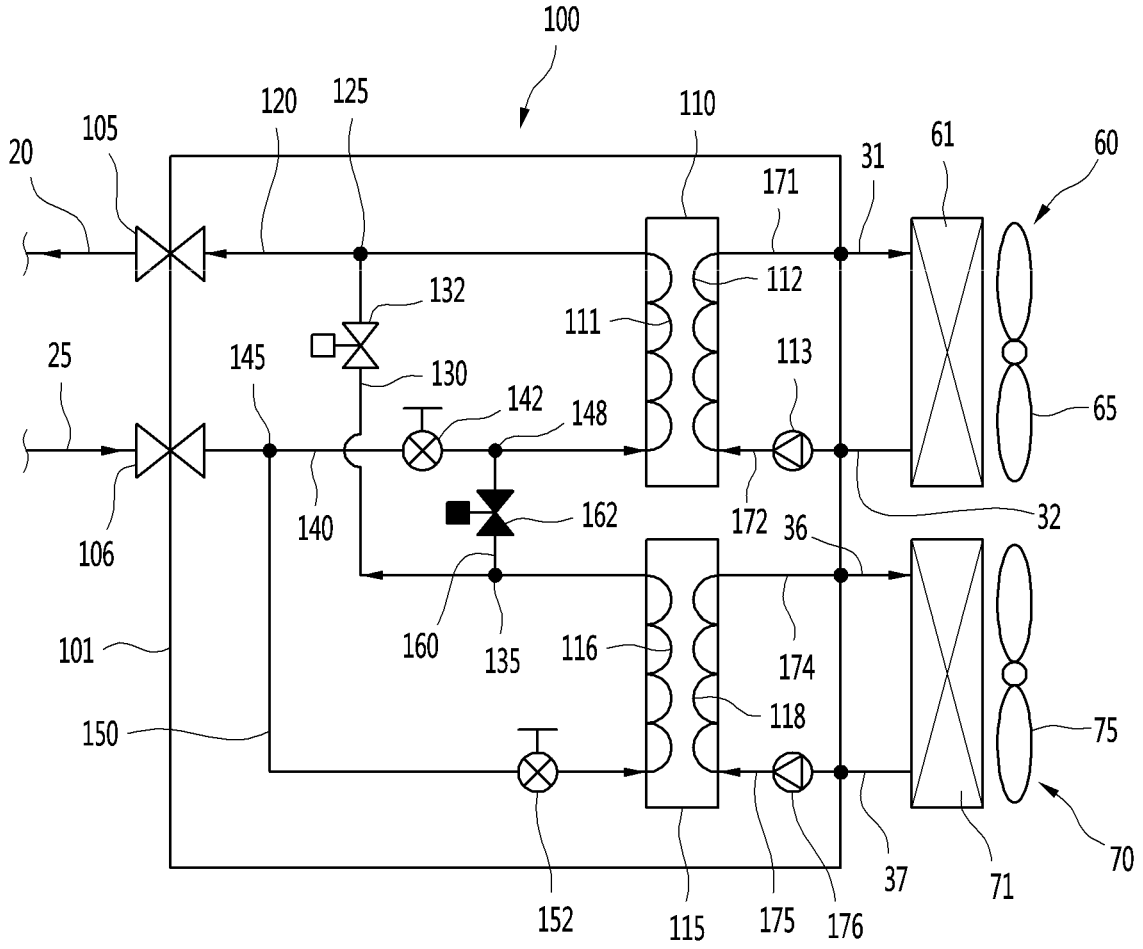
FIG. 4 is a cycle diagram illustrating an example of flow of refrigerant in the heat exchange device during a cooling operation of the air conditioning apparatus.

FIG. 3 is a cycle diagram illustrating an example of flow of refrigerant in the heat exchange device during the heating operation of the air conditioning apparatus, and FIG. 4 is a cycle diagram illustrating an example of flow of refrigerant in the heat exchange device during the cooling operation of the air conditioning apparatus.

In some implementations, referring to FIG. 3, when the heating operation is performed in the air conditioning apparatus 1, the high-pressure gas refrigerant compressed in the compressor 11 of the outdoor unit 10 is introduced into the first connection pipe 120 through the first pipe 20.

Since the first switching valve 132 is closed, the refrigerant of the first connection pipe 120 may not flow into the second connection pipe 130 from the first branch part 125, but be introduced into the first heat exchanger 110.

The refrigerant may be primarily condensed while being heat-exchanged with water in the first heat exchanger 110 and be discharged to the third connection pipe 140. Since the first expansion valve 142 is closed, and the second switching valve 162 is opened, the refrigerant of the third connection pipe 140 may be introduced from the second combination part 148 to the bypass pipe 160.

The refrigerant flowing through the bypass pipe 160 may flow from the first combination part 135 to the second connection pipe 130 and then be introduced into the second heat exchanger 115. Here, since the first switching valve 132 is in the closed state, the refrigerant may be prevented from flowing from the first combination part 135 to the first branch part 125.

The refrigerant introduced into the second heat exchanger 115 may be secondarily condensed while being heat-exchanged with water in the second heat exchanger 115 and then be discharged from the fourth connection pipe 150. Since the second expansion valve 152 is completely opened, the refrigerant may not be decompressed in the second expansion valve 152.

The refrigerant of the fourth connection pipe 150 may be introduced into the third connection pipe 140 from the second branch part 145 and be discharged to the second pipe 25 through the second service valve 106. Here, since the first expansion valve 142 is in the closed state, the refrigerant may be prevented from flowing from the second branch part 145 to the second combination part 148.

The refrigerant of the second pipe 25 may be introduced into the outdoor unit 10, decompressed in a main expansion valve 18, and evaporated in the outdoor heat exchanger 15. Also, the evaporated refrigerant may be compressed in the compressor 11 and then be introduced into the heat exchange device 100 through the first pipe 20. This refrigerant circulation may be performed.

In summary, when the air conditioning apparatus 1 performs the heating operation, the first and second heat exchangers 110 and 115 may serve as the "condensers" that condense the high-pressure gas refrigerant. Also, since the first and second heat exchangers 110 and 115 are connected in series, the refrigerant may be sequentially condensed while passing through the first heat exchanger 110 and the second heat exchanger 115. Therefore, an amount of heat of condensation of the refrigerant may increase to improve condensation performance.

The water flowing through the water flow paths 112 and 118 of the first and second heat exchangers 110 and 115 may be heated by the heat exchange with the refrigerant, and the heated water may be supplied to the first and second indoor units 60 and 70 to perform the heating.

Referring to FIG. 4, when the cooling operation is performed in the air conditioning apparatus 1, the high-pressure liquid refrigerant condensed in the outdoor heat exchanger 15 of the outdoor unit 10 is introduced into the third connection pipe 140 through the second pipe 25.

Since the first expansion valve 142 and the second expansion valve 152 are opened, the refrigerant may be branched from the second branch part 145, and a portion of the refrigerant may be decompressed into a low-pressure gas refrigerant while passing through the first expansion valve 142. Also, the remaining refrigerant branched from the second branch part 145 may be decompressed into the low-pressure gas refrigerant while flowing through the fourth connection pipe 150 to pass through the second expansion valve 152.

The refrigerant decompressed in the first expansion valve 142 may be introduced into the first heat exchanger 110 and then evaporated through heat exchange with water. Here, since the second switching valve 162 is closed, the flow of the refrigerant passing through the first expansion valve 142 may be prevented from flowing from the second combination part 148 to the bypass pipe 160.

Also, the refrigerant decompressed in the second expansion valve 152 may be introduced into the second heat exchanger 115 so as to be evaporated through heat exchange with water.

The refrigerant evaporated in the first heat exchanger 110 may be discharged to the first connection pipe 120 and then discharged to the first pipe 20 through the first service valve 105.

Also, the refrigerant evaporated in the second heat exchanger 115 may be discharged to the second connection pipe 130 and then mixed with the refrigerant of the first connection pipe 120 in the first branch part 125. Also, the mixed refrigerant may be discharged to the first pipe 20 through the first service valve 105.

Here, since the second switching valve 162 is closed, the refrigerant discharged from the second heat exchanger 115 may be prevented from flowing from the first combination part 135 to the bypass pipe 160.

The refrigerant discharged into the first pipe 20 may be introduced into the outdoor unit 10 and be suctioned into the compressor 11. The high-pressure refrigerant compressed in the compressor 11 is condensed in the outdoor heat exchanger 15, and the condensed liquid refrigerant is introduced into the third connection pipe 140 through the second pipe 25. This refrigerant circulation may be performed.

In summary, during the cooling operation of the air conditioning apparatus 1, the first and second heat exchangers 110 and 115 act as the "evaporators" for evaporating the low-pressure gas refrigerant. Also, since the first and second heat exchangers 110 and 115 are connected in parallel, the flow path of the refrigerant to be evaporated may decrease in length and increase in number. Therefore, the reduction of the evaporation pressure may be prevented, and the performance of the refrigerant cycle may be improved.

The water flowing through the water flow paths 112 and 118 of the first and second heat exchangers 110 and 115 may be cooled by the heat exchange with the refrigerant, and the cooled water may be supplied to the first and second indoor units 60 and 70 to perform the cooling.

Figure 5A:
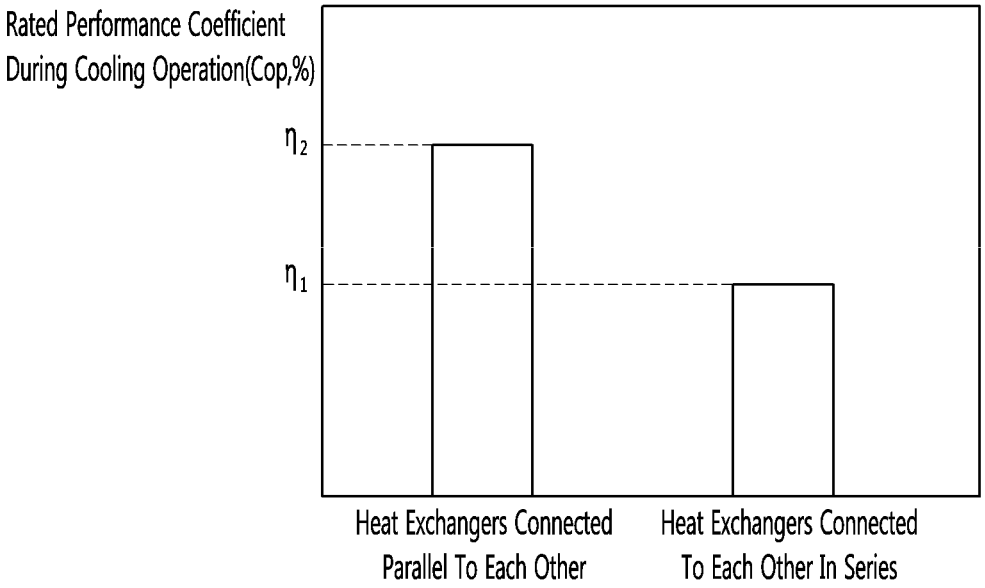
FIGS. 5A and 5B are graphs showing experimental results comparing difference in rated performance coefficients according to a series/parallel connection between the heat exchangers during a cooling operation or a heating operation of the air conditioning apparatus.
Figure 5B:
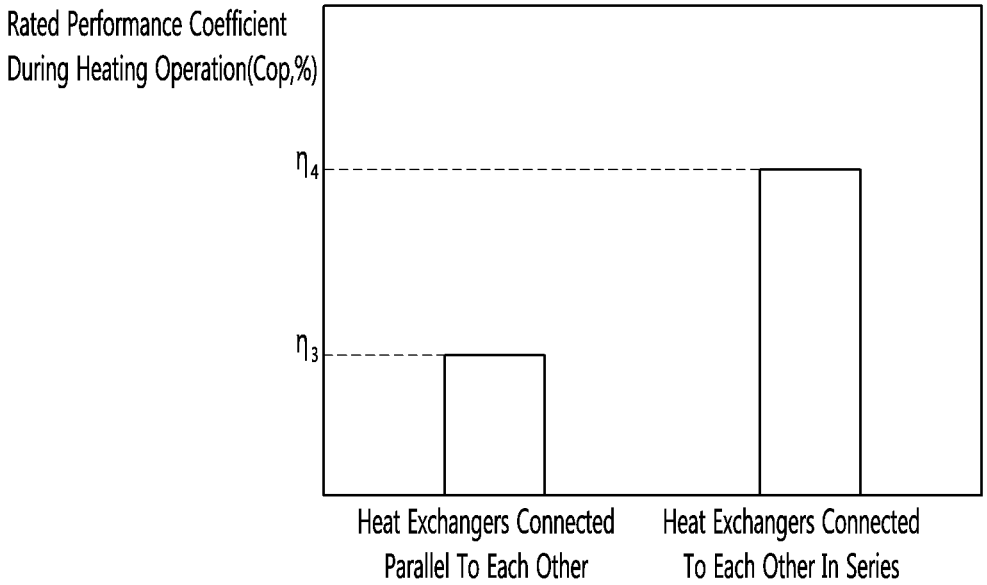

FIGS. 5A and 5B are graphs showing experimental results comparing difference in rated performance coefficients according to the series/parallel connection between the heat exchangers during the cooling operation or the heating operation of the air conditioning apparatus.

FIG. 5A illustrates an example of a difference between a rated performance coefficient (COP) when the first and second heat exchangers 110 and 115 are connected parallel to each other like the implementation and a rated performance coefficient when the first and second are connected to each other in series as a control group if the first and second heat exchangers 110 and 115 act as the evaporators during the heating operation of the air conditioning apparatus.

In detail, a second rated performance coefficient $\eta 2$ when the first and second heat exchangers 110 and 115 are connected parallel to each other is greater than a first rated performance coefficient $\eta 1$ when the first and second heat exchangers 110 and 115 are connected to each other in series to improve performance of a system.

For example, the second rated performance coefficient η2 ranges of about 98% to about 103%, and the first rated performance coefficient η1 ranges of about 90% to about 95%.

FIG. 5B illustrates an example of a difference between a rated performance coefficient (COP) when the first and second heat exchangers 110 and 115 are connected to each other in series like the implementation and a rated performance coefficient when the first and second are connected parallel to each other as a control group if the first and second heat exchangers 110 and 115 act as the condensers during the heating operation of the air conditioning apparatus.

In detail, a fourth rated performance coefficient η4 when the first and second heat exchangers 110 and 115 are connected to each other in series is greater than a third rated performance coefficient η3 when the first and second heat exchangers 110 and 115 are connected parallel to each other to improve the performance of the system.

For example, the fourth rated performance coefficient η4 ranges of about 105% to about 110%, and the third rated performance coefficient η3 ranges of about 98% to about 103%.

Hereinafter, a description will be made. Since the forgoing implementation are the same as another implementation except for only portions of the constitutions, different points therebetween will be described principally, and descriptions of the same parts will be denoted by the same reference numerals and descriptions of the foregoing implementation.

Figure 6:
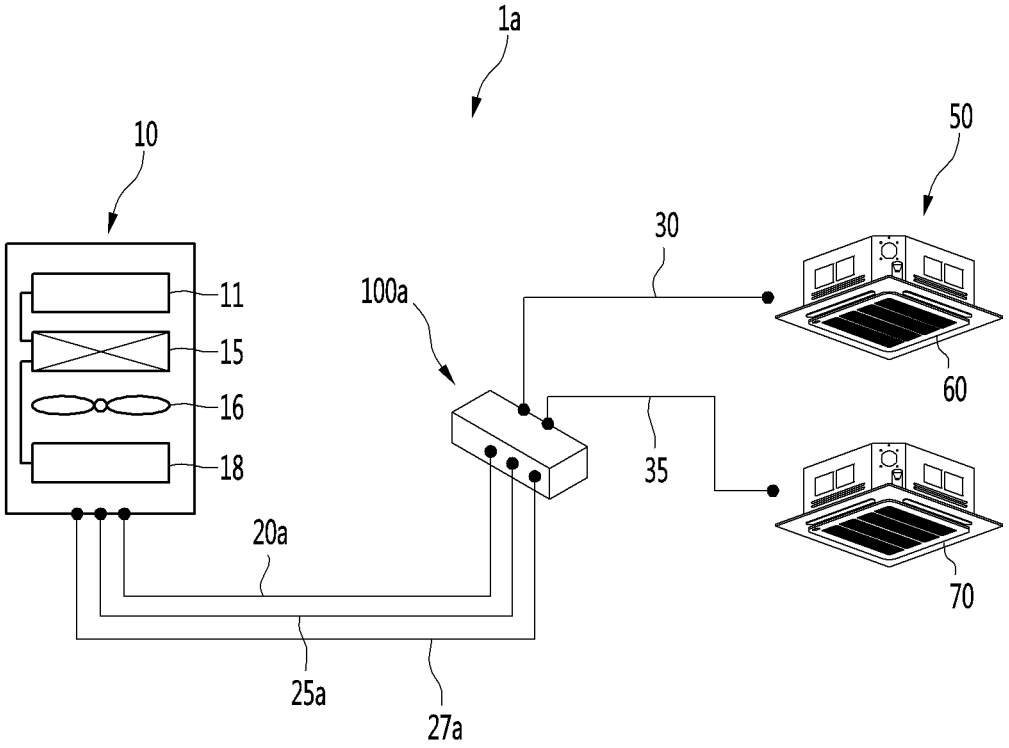
FIG. 6 is a schematic view illustrating another example configuration of an air conditioning apparatus.
Figure 7:
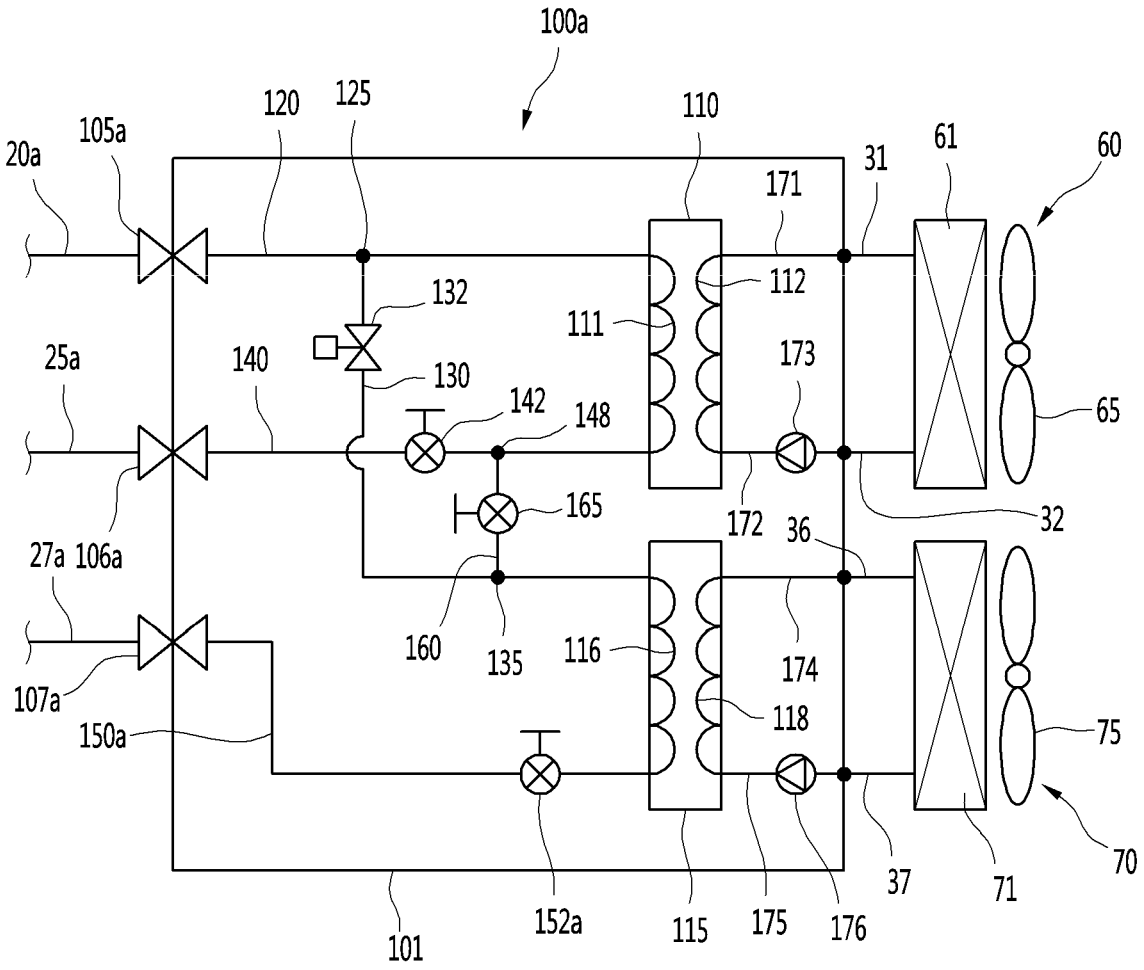
FIG. 7 is a cycle diagram illustrating an example configuration of a heat exchange device of the air conditioning apparatus in FIG. 6.

FIG. 6 is a schematic view illustrating a configuration of an air conditioning apparatus, and FIG. 7 is a cycle diagram illustrating a configuration of a heat exchange device.

FIGS. 6 and 7, an air conditioning apparatus 1*a* includes an outdoor unit 10, an indoor unit 50, and a heat exchange device 100*a* connected to the outdoor unit 10 and the indoor unit 50.

The outdoor unit 10 and the heat exchange device 100*a* may be fluidly connected by a first fluid. For example, the first fluid may include a refrigerant. The refrigerant may flow through a refrigerant-side path of a heat exchanger provided in the heat exchange device 100 and the outdoor unit 10.

The outdoor unit 10 may include a compressor 11, an outdoor heat exchanger 15, an outdoor fan 16, and a main expansion valve 18 (EEV). The above-described parts will be quoted from the descriptions of the foregoing implementation.

The air conditioning apparatus 1*a* further include three pipes 20*a*, 25*a*, and 27*a* connecting the outdoor unit 10 to the heat exchange device 100*a*. The three pipes 20*a*, 25*a*, and 27*a* include a first pipe 20*a* as a gas pipe (a high-pressure gas pipe) through which a high-pressure gas refrigerant flows, a second pipe 25*a* as a liquid pipe through a liquid refrigerant flows, and a third pipe 27*a* as a gas pipe (a low-pressure gas pipe) through which a low-pressure gas refrigerant flows.

That is, the outdoor unit 10 and the heat exchange device 100*a* may have a "three pipe connection structure", and the refrigerant may circulate through the outdoor unit 10 and the heat exchange device 100*a* via the three pipes 20*a*, 25*a*, and 27*a*.

The heat exchange device 100*a* and the indoor unit 50 may be fluidly connected by a second fluid. For example, the second fluid may include water. The water may flow through a water-side flow path of a heat exchanger provided in the heat exchange device 100*a* and the outdoor unit 10. The heat exchanger may include a plate-type heat exchanger.

The indoor unit 50 may include a plurality of indoor units 60 and 70. The plurality of indoor units 60 and 70 include a first indoor unit 60 and a second indoor unit 70.

The air conditioning apparatus 1*a* further includes pipes 30 and 35 connecting the heat exchange device 100*a* to the indoor unit 50. The description of the pipes 30 and 35 are derived from the description and the drawings of the foregoing implementation.

The water may circulate through the heat exchange device 100*a* and the indoor unit 50 via the first and second indoor unit connection pipes 30 and 35. As the number of indoor units increases, the number of pipes connecting the heat exchange device 100*a* to the indoor units may also increase.

In some implementations, the refrigerant circulating through the outdoor unit 10 and the heat exchange device 100*a* and the water circulating through the heat exchange device 100*a* and the indoor unit 50 may be heat-exchanged with each other through heat exchangers 110 and 115 provided in the heat exchange device 100*a*, and water cooled or heated through the heat exchange may be heat-exchanged with indoor heat exchangers 61 and 72 provided in the indoor unit 50 to perform cooling or heating in an indoor space.

The heat exchange device 100*a* includes a first heat exchanger 110 fluidly connected to the first indoor unit 60 and a second heat exchanger 115 fluidly connected to the second indoor unit 70. The configurations of the first and second heat exchangers 110 and 115, the structure of the water flow path between the first heat exchanger 110 and the first indoor unit 60, and the structure of the water flow path between the second heat exchanger 115 and the second indoor unit 70 are the same as or similar to those according to the foregoing implementation, and thus, their detailed descriptions will be omitted here.

The heat exchange device 100*a* includes a first service valve 105*a* connected to the first pipe 20*a*, a second service valve 106*a* connected to the second pipe 25*a*, and a third service valve 107*a* connected to the third pipe 27*a*.

The first to third pipes 20*a*, 25*a*, and 27*a* may be connected to the heat exchange device 100*a* through the first to third service valves 105*a*, 106*a*, and 107*a*, and thus, the outdoor unit 10 and the heat exchange device 100*a* may realize "third pipe connection".

The heat exchange device 100*a* includes a first connection pipe 120, a second connection pipe 130, a first branch part 125, a first switching valve 132, a first combination part 135, a third connection pipe 140, a first expansion valve 142, a second combination part 148, and a bypass pipe 160, which are described in the foregoing implementation. Descriptions with respect to the above-described constituents will be derived from those according to the foregoing implementation.

Here, the first connection pipe 120 is connected to the first pipe 20*a* through a first service valve 105*a*, and the third connection pipe 140 is connected to the second pipe 25*a* through the second service valve 106*a*.

In the foregoing implementation, the second switching valve 162 is installed in the bypass pipe 160. However, in this implementation, a third expansion valve 165 is installed in place of the second switching valve 162. The third expansion valve 165 may be configured as an electronic expansion valve (EEV) capable of adjusting an opening degree for reducing a pressure of the refrigerant.

For convenience of description, the second switching valve 162 according to the foregoing implementation and the third expansion valve 165 according to this implementation may be referred to as a "bypass valve".

The heat exchanger device 100*a* further includes a fourth connection pipe 150*a* connected to a third service valve 107*a*. That is, the fourth connection pipe 150*a* may be connected to a third pipe 27*a* through the third service valve 107*a*.

A second expansion valve 152*a* may be installed in the fourth connection pipe 150*a*. The second expansion valve 152*a* may be configured as an electronic expansion valve (EEV) capable of adjusting an opening degree for reducing a pressure of the refrigerant.

Figure 8:
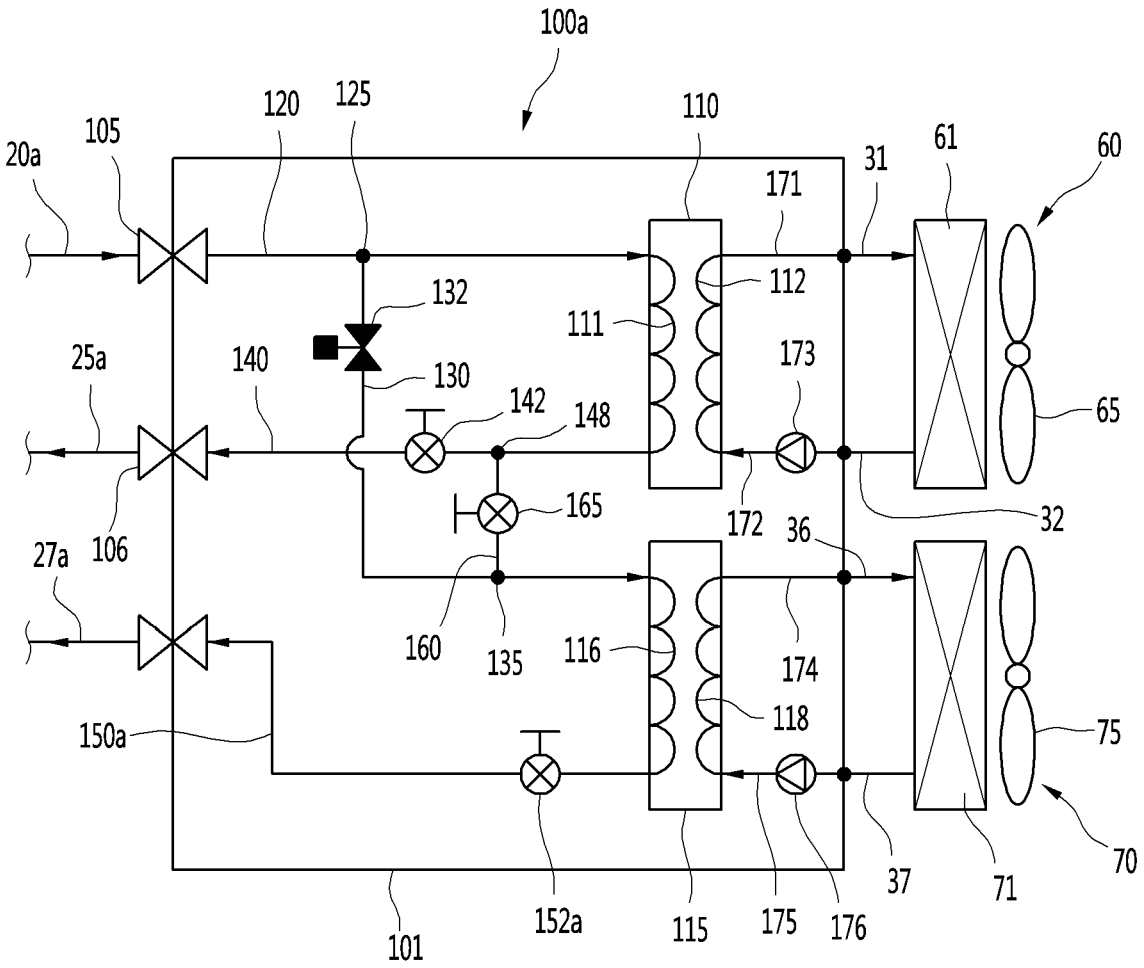
FIG. 8 is a cycle diagram illustrating an example of flow of refrigerant in the heat exchange device during a heating operation of the air conditioning apparatus in FIG. 6.

FIG. 8 is a cycle diagram illustrating a flow of a refrigerant in the heat exchange device during the simultaneous operation of the air conditioning apparatus.

Referring to FIG. 8, when the simultaneous operation is performed in the air conditioning apparatus 1*a*, the high-pressure gas refrigerant compressed in the compressor 11 of the outdoor unit 10 is introduced into the first connection pipe 120 through the first pipe 20*a*. Here, the "simultaneous operation" may be understood as an operation in which the heating is performed in the first indoor unit 60, and the cooling is performed in the second indoor unit 70.

Since the first switching valve 132 is closed, the refrigerant of the first connection pipe 120 may not flow into the second connection pipe 130 from the first branch part 125, but be introduced into the first heat exchanger 110.

The refrigerant may be condensed while being heat-exchanged with water in the first heat exchanger 110 and then discharged to the third connection pipe 140. In this process, the water circulating through the first indoor unit 60 may be heated, and the heated water may be used as a heat source for heating by being heat-exchanged with indoor air in the first indoor unit 60.

Since the first expansion valve 142 and the third expansion valve 165 are opened, a portion of the refrigerant in the third connection pipe 140 may flow from the second combination part 148 to the second branch part 145, and the remaining refrigerant may be introduced into the bypass pipe 160.

The refrigerant flowing to the second branch part 145 may be discharged through the first expansion valve 142 to the second pipe 25*a* and then introduced into the outdoor unit 10. In this case, the refrigerant may not be large that is enough to be decompressed in the process of passing through the first expansion valve 142.

The refrigerant introduced into the outdoor unit 10 may be decompressed in a main expansion valve 18, evaporated in the outdoor heat exchanger 15, suctioned into the compressor 11, and compressed.

The refrigerant introduced into the bypass pipe 160 is decompressed while passing through the third expansion valve 165, and the decompressed refrigerant is introduced into the second heat exchanger 115 from the first combination part 135. Here, since the first switching valve 132 is in a closed state, the refrigerant may be prevented from flowing from the first combination part 135 to the first branch part 125.

The refrigerant introduced into the second heat exchanger 115 may be evaporated while being heat-exchanged with water circulating in the second indoor unit 70, and the evaporated refrigerant may be discharged to the third pipe 27*a* via the fourth connection pipe 150*a* and then be introduced into the outdoor unit 10. In this process, the water circulating through the second indoor unit 70 is cooled, and the cooled water may be used as a heat source for cooling by being heat-exchanged with indoor air in the second indoor unit 70.

Also, the refrigerant introduced into the outdoor unit 10 may be suctioned into the compressor 11 and then compressed. Since the refrigerant circulates, a portion of the indoor units may perform the heating operation, and other indoor units may perform the cooling operation easily.

In some implementations, the refrigerant flow path may vary in the heat exchange device during the cooling operation or the heating operation to improve the performance.

When the plurality of heat exchangers, which are provided in the heat exchange device, act as the evaporators during the cooling operation, the refrigerant may be branched and introduced into the plurality of heat exchangers to increase in number of refrigerant flow paths and reduce the length of each of the refrigerant flow paths (parallel connection between the heat exchangers), thereby preventing the evaporation pressure from being reduced.

When the plurality of heat exchangers act as the condensers during the heating operation, the refrigerant may sequentially pass through the plurality of heat exchangers to increase in length and reduce in number of refrigerant flow paths (series connection between the heat exchangers), thereby improving the condensation performance in the heat exchangers.

Also, when the switching operation for the cooling operation or the heating operation is performed, the outdoor unit and the heat exchange device may be connected to each other through the two pipes so as to be simplified in configuration thereof.

On the other hand, when the simultaneous operation in which the cooling operation and the heating operation are performed at the same time is performed, the outdoor unit and the heat exchange device may be connected to each other through the three pipes to easily perform the circulation of the refrigerant.

Also, the configuration of the heat exchange device connected to the outdoor unit through the two pipes and the configuration of the heat exchange device connected to the outdoor unit through the three pipes may be almost similar to each other except that the pipes are grounded so that the heat exchange device for the switching operation or the simultaneous operation is easily manufactured.

As a result, the heat exchange device may be connected to the outdoor unit through the two or three pipes to perform the switching operation or the simultaneous operation.

In some examples, when the plate-type heat exchanger acts as a condenser, it may be advantageous to reduce the number of refrigerant flow paths and increase a length of the refrigerant flow path so as to increase in condensation performance. When the plate-type heat exchanger acts as an evaporator, it may be advantageous to increase a number of refrigerant flow paths and reduce a length of the refrigerant flow paths so as to prevent a pressure loss from occurring, i.e., prevent an evaporation pressure from being reduced.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioning apparatus comprising:
an outdoor unit configured to circulated refrigerant;
a first pipe and a second pipe that are connected to the outdoor unit;
an indoor unit configured to circulate water; and
a heat exchange device that connects the outdoor unit to the indoor unit, the heat exchange device comprising:
a first heat exchanger and a second heat exchanger that are each configured to perform heat exchange between the refrigerant and the water,
a first connection pipe that is connected to the first pipe and that extends to the first heat exchanger,
a second connection pipe that extends from the first connection pipe to the second heat exchanger,
a third connection pipe that is connected to the second pipe and that extends to the first heat exchanger,
a bypass pipe that extends from the third connection pipe to the second connection pipe and that is configured to guide the refrigerant passing through the first heat exchanger to the second heat exchanger,
a bypass valve installed at the bypass pipe,
a first branch part disposed at the first connection pipe, wherein the second connection pipe is connected to the first branch part and to the second heat exchanger,
a first combination part disposed at the second connection pipe,
a second combination part disposed at the third connection pipe, wherein the bypass pipe extends from the first combination part to the second combination part, and
a first switching valve installed at the second connection pipe and disposed between the first branch part and the first combination part.

2. The air conditioning apparatus according to claim 1, wherein the indoor unit comprises a first indoor unit and a second indoor unit, and
wherein the first heat exchanger comprises:
a first refrigerant flow path connected to the first connection pipe; and
a first water flow path connected to the first indoor unit.

3. The air conditioning apparatus according to claim 2, wherein the second heat exchanger comprises:
a second refrigerant flow path connected to the second connection pipe; and
a second water flow path connected to the second indoor unit.

4. The air conditioning apparatus according to claim 1, wherein the outdoor unit and the heat exchange device are coupled to each other by two pipes comprising the first pipe and the second pipe.

5. The air conditioning apparatus according to claim 4, further comprising:
a second branch part disposed at the third connection pipe; and
a fourth connection pipe that extends from the second branch part to the second heat exchanger.

6. The air conditioning apparatus according to claim 5, further comprising a first expansion valve installed at the third connection pipe and disposed between the second branch part and the second combination part.

7. The air conditioning apparatus according to claim 5, further comprising a second expansion valve installed at the fourth connection pipe.

8. The air conditioning apparatus according to claim 4, wherein the bypass valve comprises a second switching valve configured to adjust opening and closing of the bypass pipe.

9. The air conditioning apparatus according to claim 1, further comprising a third pipe coupled to the outdoor unit, and
wherein the outdoor unit and the heat exchange device are coupled to each other by three pipes comprising the first pipe, the second pipe, and the third pipe.

10. The air conditioning apparatus according to claim 9, wherein the heat exchange device further comprises a fourth connection pipe that is connected to the third pipe and that extends to the second heat exchanger.

11. The air conditioning apparatus according to claim 10, further comprising:
a first expansion valve installed at the third connection pipe; and
a second expansion valve installed at the fourth connection pipe,
wherein the bypass valve comprises a third expansion valve installed at the bypass pipe.

12. The air conditioning apparatus according to claim 1, wherein the first heat exchanger or the second heat exchanger comprises a plate-shaped heat exchanger.

13. An air conditioning apparatus comprising:
an outdoor unit configured to circulate refrigerant;
a first pipe and a second pipe that are connected to the outdoor unit;
an indoor unit configured to circulate water; and
a heat exchange device that connects the outdoor unit to the indoor unit, the heat exchange device comprising:
a first heat exchanger and a second heat exchanger that are configured to perform heat exchange between the refrigerant and the water,
a first connection pipe that is connected to the first pipe and that extends to the first heat exchanger, the first connection pipe comprising a first branch part,
a second connection pipe that extends from the first branch part of the first connection pipe to the second heat exchanger, the second connection pipe comprising a first combination part,
a third connection pipe that is connected to the second pipe and that extends to the first heat exchanger, the third connection pipe comprising a second branch part and a second combination part,
a fourth connection pipe that extends from the second branch part of the third connection pipe to the second heat exchanger,
a first expansion valve installed at the third connection pipe,
a bypass pipe that extends from the first combination part of the second connection pipe to the second combination part of the third connection pipe,
a bypass valve installed at the bypass pipe, and
a second expansion valve installed at the fourth connection pipe.

14. The air conditioning apparatus according to claim 13, wherein the indoor unit comprises a first indoor unit and a second indoor unit,
wherein the first heat exchanger comprises:
a first refrigerant flow path connected to the first connection pipe, and
a first water flow path connected to the first indoor unit, and wherein the second heat exchanger comprises:

a second refrigerant flow path coupled to the second connection pipe, and a second water flow path connected to the second indoor unit.

15. The air conditioning apparatus according to claim 13, wherein the first expansion valve is disposed between the second branch part and the second combination part.

16. The air conditioning apparatus according to claim 13, further comprising a third pipe coupled to the outdoor unit, and wherein the outdoor unit and the heat exchange device are coupled to each other by three pipes comprising the first pipe, the second pipe, and the third pipe.

17. An air conditioning apparatus comprising:

an outdoor unit configured to circulated refrigerant;

a first pipe and a second pipe that are connected to the outdoor unit;

a third pipe coupled to the outdoor unit;

an indoor unit configured to circulate water; and a heat exchange device that connects the outdoor unit to the indoor unit, the heat exchange device comprising:

a first heat exchanger and a second heat exchanger that are each configured to perform heat exchange between the refrigerant and the water, a first connection pipe that is connected to the first pipe and that extends to the first heat exchanger, a second connection pipe that extends from the first connection pipe to the second heat exchanger, a third connection pipe that is connected to the second pipe and that extends to the first heat exchanger, a bypass pipe that extends from the third connection pipe to the second connection pipe and that is configured to guide the refrigerant passing through the first heat exchanger to the second heat exchanger, and a bypass valve installed at the bypass pipe, wherein the outdoor unit and the heat exchange device are coupled to each other by three pipes comprising the first pipe, the second pipe, and the third pipe.

18. The air conditioning apparatus according to claim 17, wherein the heat exchange device further comprises a fourth connection pipe that is connected to the third pipe and that extends to the second heat exchanger.

19. The air conditioning apparatus according to claim 18, further comprising:

a first expansion valve installed at the third connection pipe; and a second expansion valve installed at the fourth connection pipe, wherein the bypass valve comprises a third expansion valve installed at the bypass pipe.

20. An air conditioning apparatus comprising:

an outdoor unit configured to circulate refrigerant;

a first pipe and a second pipe that are connected to the outdoor unit;

a third pipe coupled to the outdoor unit;

an indoor unit configured to circulate water; and a heat exchange device that connects the outdoor unit to the indoor unit, the heat exchange device comprising:

a first heat exchanger and a second heat exchanger that are configured to perform heat exchange between the refrigerant and the water, a first connection pipe that is connected to the first pipe and that extends to the first heat exchanger, the first connection pipe comprising a first branch part, a second connection pipe that extends from the first branch part of the first connection pipe to the second heat exchanger, the second connection pipe comprising a first combination part, a third connection pipe that is connected to the second pipe and that extends to the first heat exchanger, the third connection pipe comprising a second branch part and a second combination part, a fourth connection pipe that extends from the second branch part of the third connection pipe to the second heat exchanger, a first expansion valve installed at the third connection pipe, a bypass pipe that extends from the first combination part of the second connection pipe to the second combination part of the third connection pipe, and a bypass valve installed at the bypass pipe, wherein the outdoor unit and the heat exchange device are coupled to each other by three pipes comprising the first pipe, the second pipe, and the third pipe.

* * * * *